US005579864A

United States Patent [19]

Shorrock

[11] Patent Number: 5,579,864

[45] Date of Patent: Dec. 3, 1996

[54] STEP UP PLATFORM WITH FOLDING HAND RAIL

[76] Inventor: Larry J. Shorrock, Box 186, Group 327, R.R. #3, Selkirk, Manitoba, Canada, R1A 2A8

[21] Appl. No.: 290,505

[22] Filed: Aug. 15, 1994

[51] Int. Cl.[6] ..... A47C 9/02

[52] U.S. Cl. ..... 182/113; 182/222; 182/16

[58] Field of Search ..... 182/222, 223, 182/113, 12–17, 32, 33; 297/423.39, 423.41; 190/115

[56] References Cited

U.S. PATENT DOCUMENTS

| | | | |
|---|---|---|---|
| 3,743,051 | 7/1973 | Cramer | 182/15 |
| 3,841,437 | 10/1974 | Caughey | 182/16 |
| 4,471,969 | 9/1984 | Zabala | 297/423.41 X |
| 4,950,033 | 8/1990 | Anderson | 182/334 |
| 5,385,220 | 1/1995 | Pond | 190/115 X |

*Primary Examiner*—Alvin C. Chin-Shue
*Attorney, Agent, or Firm*—Adrian D. Battison; Murray E. Thrift

[57] ABSTRACT

The present invention relates to a step up device which provides a large stable platform with a hand rail to give the user a safe method of elevation. Older and/or infirm people frequently experience limited movement of their limbs making it difficult to get into bed. To do this an elevation aid is often required. Current stools and step up devices for this purpose are widely available in hospitals but are cumbersome taking up much storage space and are difficult to transport from place to place for use by different patients. This invention provides an improved step-up device which reduces storage space and improves transportation. The present invention provides a large stable platform with a hand rail to provide the user with a safe method of elevation. The hand rail is foldable, and is positioned to provide stability to the platform. The top of the platform is designed with a non-slip surface and a non-skid material is fastened to the legs to provide further stability. Rolling means may be provided to aid in ease of movement of the step up platform. The rolling means are installed in such a manner that the platform must be tilted upon one edge for the rolling means to be able to engage the supporting surface thus preventing the device from accidentally rolling while in use.

7 Claims, 4 Drawing Sheets

STEP UP PLATFORM WITH FOLDING HAND RAIL

BACKGROUND OF THE INVENTION

The present invention relates to a step up device which provides a large stable platform with a hand rail to give the user a safe method of elevation.

Older and/or infirm people frequently experience limited movement of their limbs, physical instability, and reduced strength. These factors result in such persons experiencing great difficulty in transferring themselves in and out of bed. This is particularly the case in hospitals, nursing homes, and care centres where beds are considerably higher due to castors and elevating devices fixed to them. To get into bed an elevation aid is often required. Current stools and step up devices have a limited surface area and are unstable when a hand rail is attached. As well caregivers experience physical difficulty in moving current stools and step up devices and are at risk of injury when doing so. Devices of this type are widely available in hospitals but are cumbersome taking up much storage space and are difficult to transport from place to place for use by different patients.

SUMMARY OF THE INVENTION

It is one object of the present invention to provide an improved step-up device of this type which reduces storage space and improves transportation.

The present invention is a step up platform comprising: a base platform with a raised horizontal upper surface upon which a person may stand; means to support and hold the base platform in place on a supporting surface; a generally vertical hand rail fixed to the base platform offset from a line through the centre of the base platform and towards one edge and having at least one horizontal hand hold, said hand rail being movable into a plurality of positions from a generally vertical position to a generally horizontal position and being able to fold into the horizontal position for transport or storage.

In the preferred embodiment the present invention provides a large stable platform with a hand rail to provide the user with a safe method of elevation. It is equipped with a foldable hand rail, positioned to provide stability to the platform. The top of the platform is designed with a non-slip surface and a non-skid material is fastened to the legs to provide further stability.

This device improves on existing devices in that the hand rail may be folded from a generally vertical position to a generally horizontal position and may be locked in place at each end of its range of movement. This makes movement and storage of the device easier and safer. The height of the hand rail may be made adjustable to meet the needs of individual usage.

Rolling means may be provided to aid in ease of movement of the step up device. The rolling means are installed in such a manner that the platform must be tilted upon one edge for the rolling means to be able to engage the supporting surface thus preventing the device from accidentally rolling while in use.

The invention will now be described with reference to the accompanying drawings in which:

DETAILED DESCRIPTION

Figure 1:
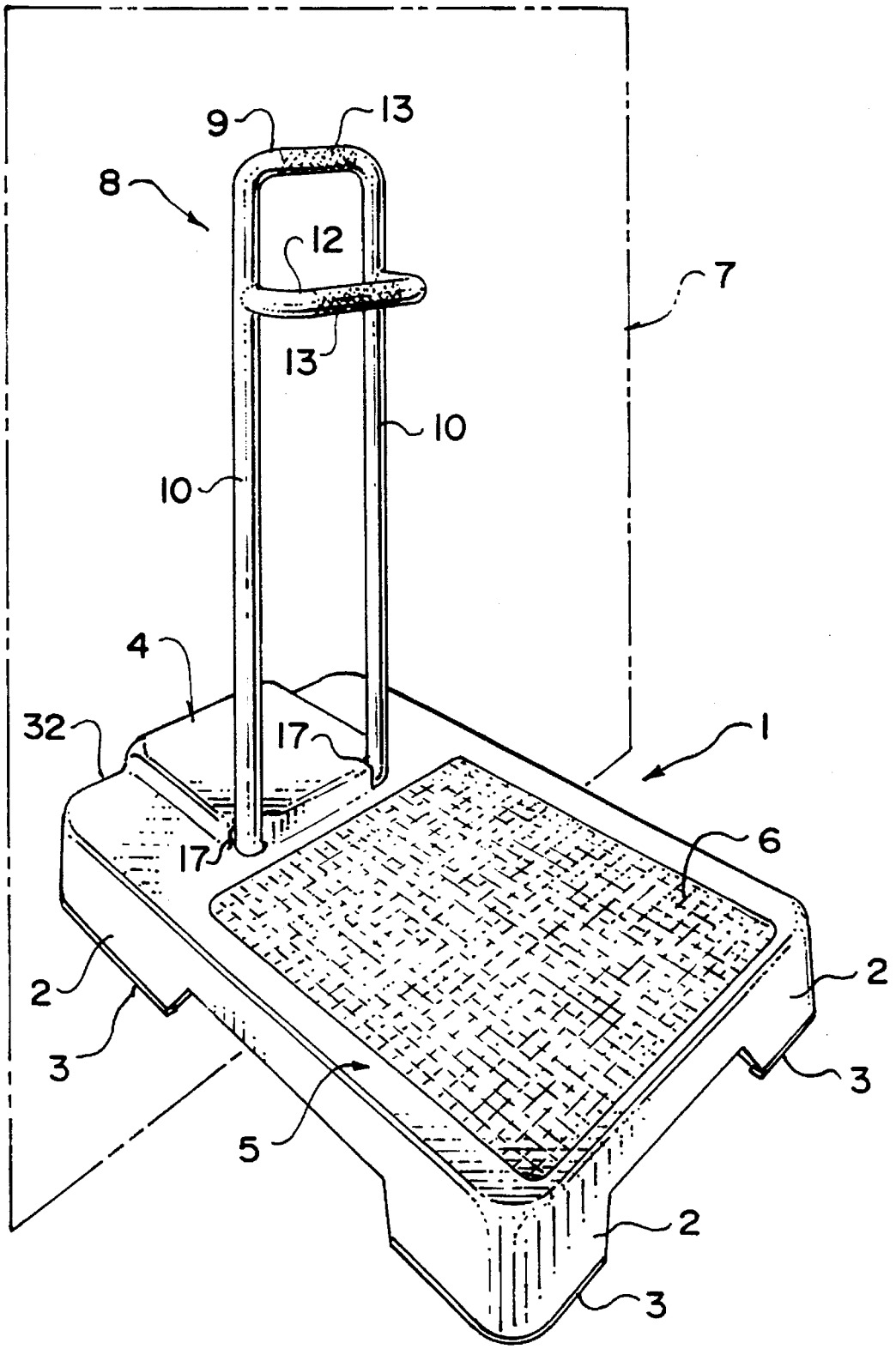
FIG. 1 is a perspective view of the step up platform in the preferred embodiment.
Figure 3:
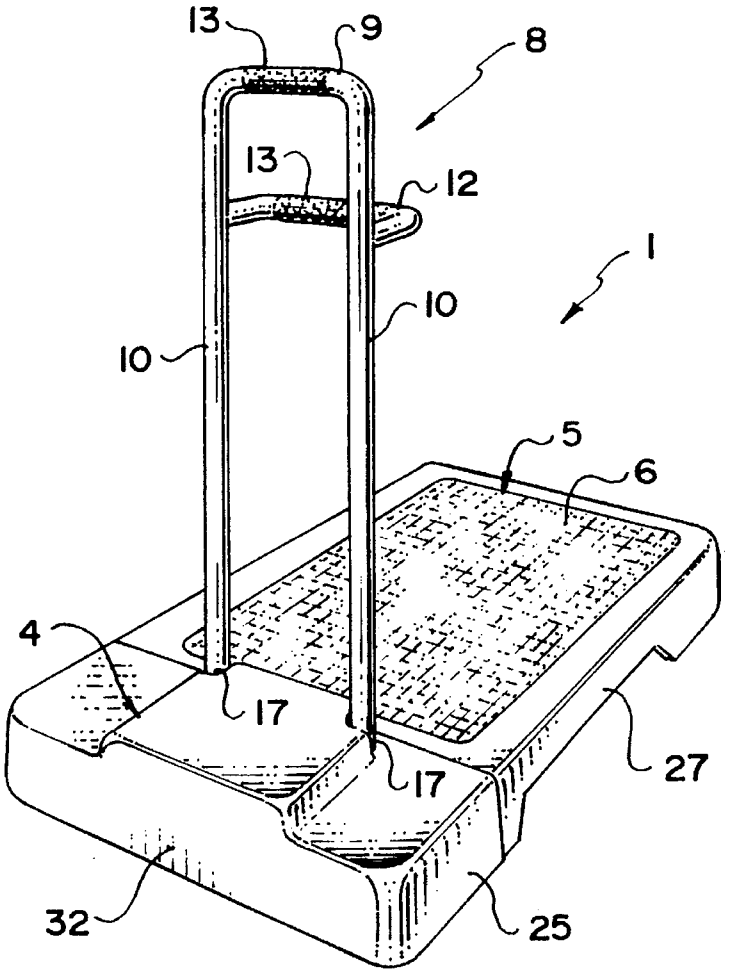
FIG. 3 is a rear perspective view of the step up platform in an alternative embodiment.

Referring to FIG. 1 the step up platform is shown as comprising a base platform 1, a hand rail 8 and a housing unit 4. In the preferred embodiment the base platform is a molded rectangular section made of plastic or other material raised up off the ground to an appropriate height for stepping onto with a wide horizontal surface 5 for stability. The horizontal surface is covered with a non slip material or surface texture 6 to prevent slipping and ensure safety. Legs 2 are molded on to the bottom of the base platform at each of the four corners of the rectangle to provide firm support for the base platform. Each leg has a piece of non-skid material 3 affixed to its bottom parallel to the horizontal plane to ensure that the base platform 1 remains in a fixed position with respect to the supporting surface preventing it from sliding out from under the person stepping onto it.

Figure 2:
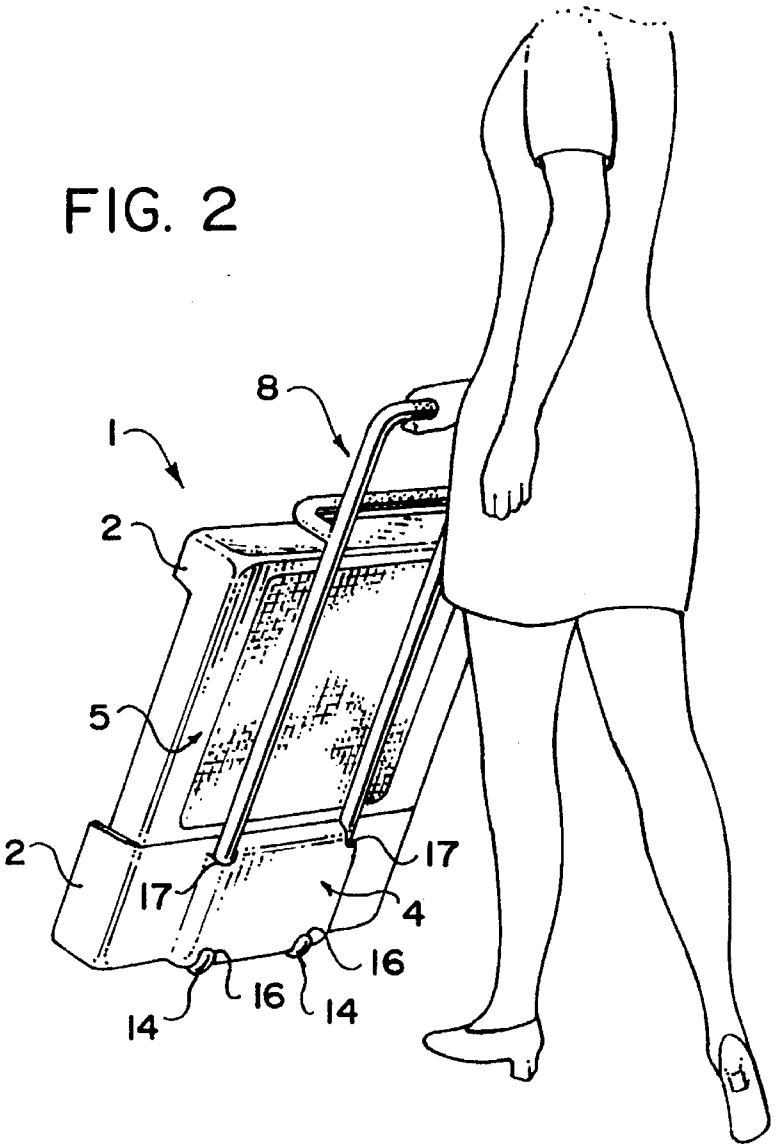
FIG. 2 is a view of the step up platform with rolling means in use.
Figure 6A:
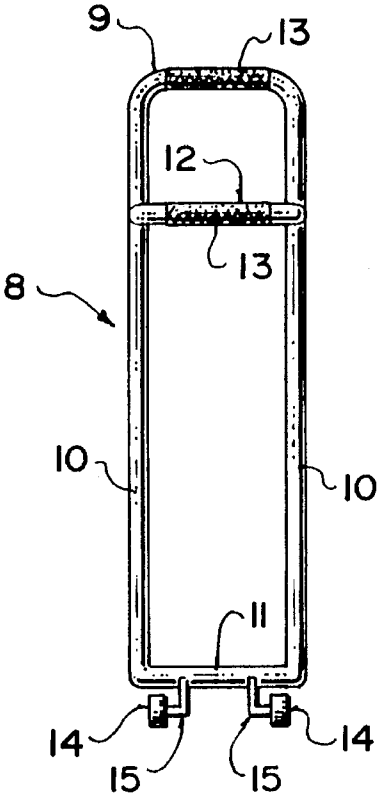
FIGS. 6 and 6A is a front view of the hand rail showing embodiments with and without rolling means.
Figure 6:
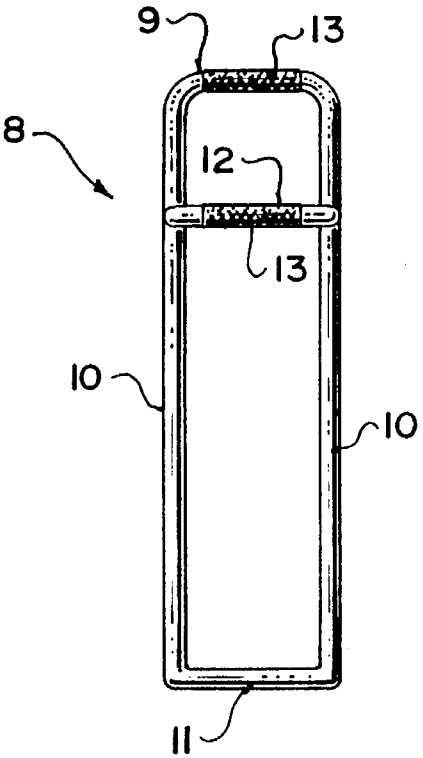
Figure 4:
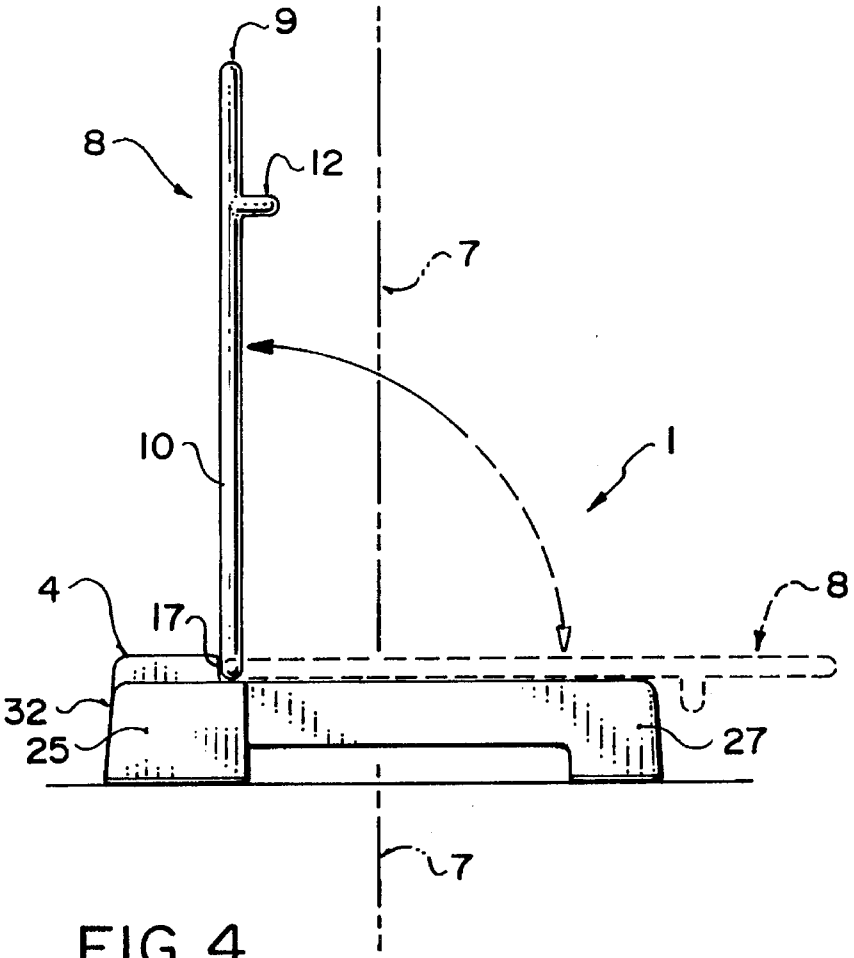
FIG. 4 is a side view of step up platform showing movement of the hand rail.

Towards one end of the long sides of the rectangular base platform, in from an edge 32 perpendicular to said long sides of the base platform and offset from a plane 7 through the centre of the base platform is positioned a hand rail 8. The bottom of the legs of the hand rail insert into the holes 17 in the housing unit 4. As shown in FIG. 6 the hand rail consists of a length of metal tubing or other appropriate material bent or formed into a closed rectangular loop such that a horizontal hand hold 9 is formed by one short side; this becomes the top of the hand rail, a vertical leg 10 is created by each long side, and a cross member 11 is formed by the other short side; this becomes the bottom of the hand rail. Referring to FIG. 4 the hand rail 8 may be folded into a range of positions from a generally vertical position to a generally horizontal position and can be locked in the vertical or horizontal position. This is a great advantage over existing step up platforms since it allows the device to be easily moved and stored. In this embodiment a second hand hold 12 is fixed by welding or other means to the hand rail 8, additional hand holds may be added if desired. The second hand hold is located at a distance down from the top of the hand rail, on the legs of said hand rail, and projects out from said legs towards a vertical plane 7 through the centre of the base platform. Both hand holds 9 and 12 have fixed to them a non slip material or surface texture 13 to ensure safe usage. In embodiments with rolling means the rolling means 14 are attached to the cross member 11 by fixing means 15. Referring to FIG. 2, the rolling means project through holes 16 in the housing unit 4, when the hand rail is locked in the horizontal position. To engage the rolling means the platform is placed on one edge and pulled by the handle.

Figure 5:
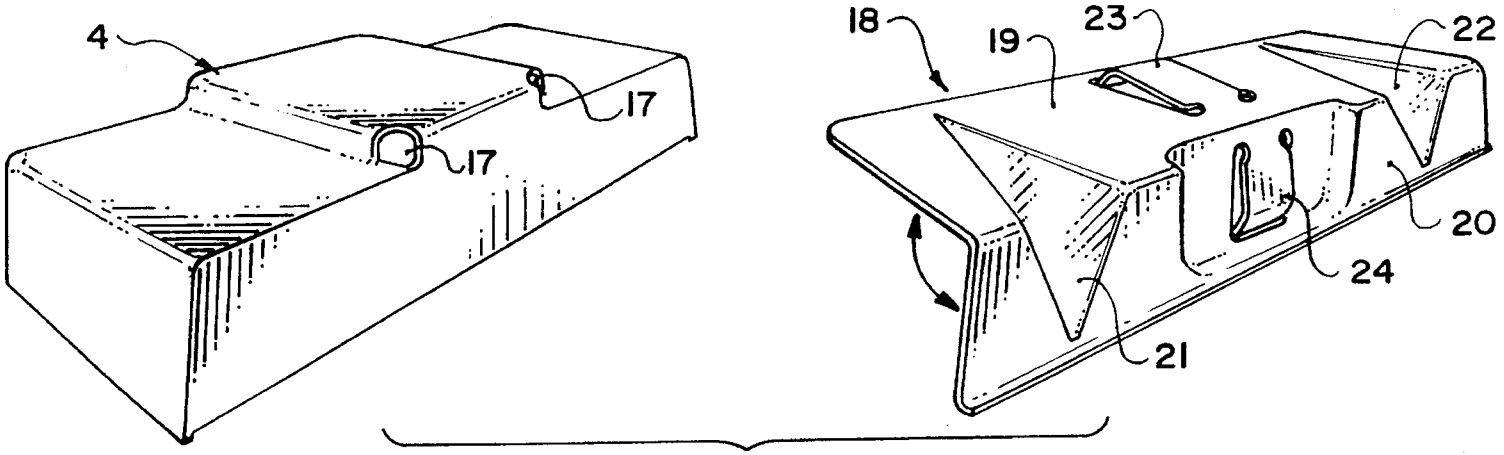
FIG. 5 is a view of the step up platform showing housing unit and locking mechanism.
Figure 7:
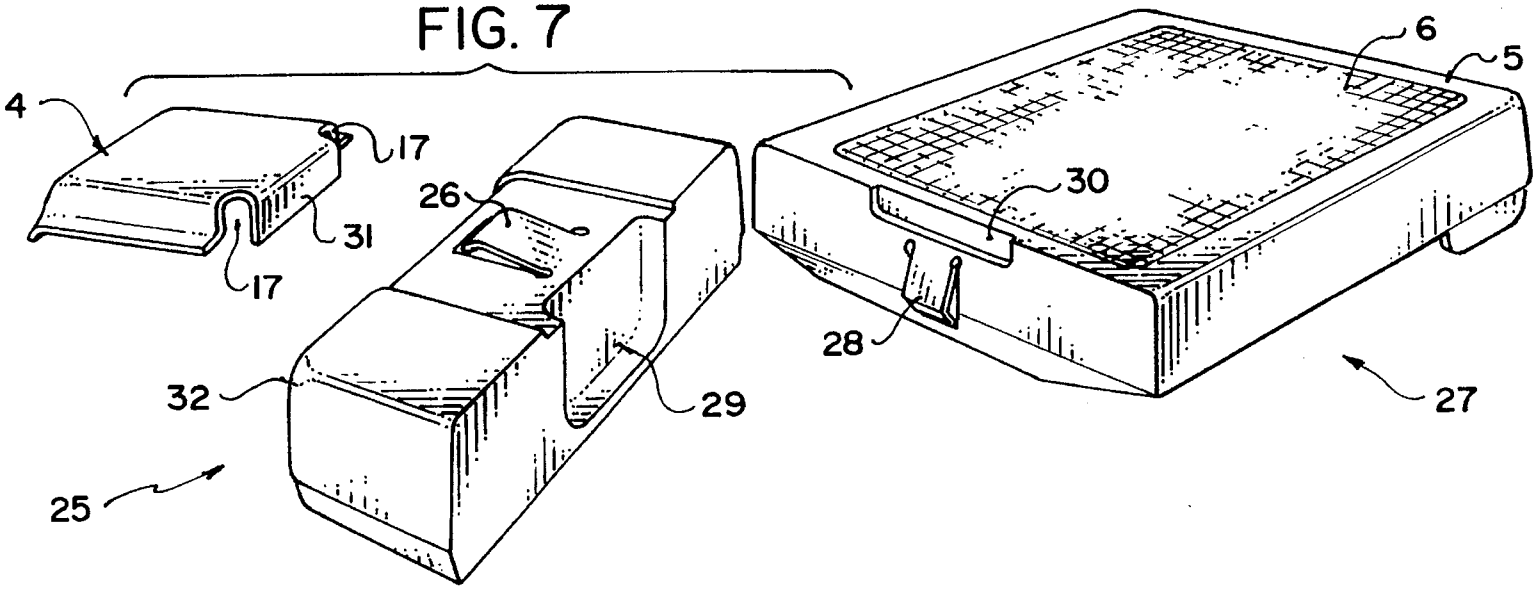
FIG. 7 is a view of the step up platform showing alternative embodiments of the base platform, housing unit, and locking mechanism.

Referring to FIGS. 4,5,6 the housing unit 4 is mounted adjacent side 32 of the base platform I and in towards the plane 7, it contains a locking mechanism 18 that enables the hand rail 8 to be placed in a vertical or horizontal position and lock in place when pushed in towards the housing. The locking mechanism 18 comprises a thin rectangular sheet bent at an angle so as to have two faces 19 and 20 which are oriented into a generally vertical and generally horizontal position, at each end of the long sides of the rectangle and on each face is a channel 21 and 22 which is deepest at the point of intersection of the two faces 19,20 and which become shallow as distance from the intersection increases. These channels 21,22 supply rigidity to the locking mechanism. On each face of the locking mechanism is a thin flange 23,24 projecting up on a shallow angle from the surface upon which it is mounted in the direction away from the opening in the housing. At a distance along its length the locking device is bent downwards at a sharper angle towards the surface on which it is mounted. This arrangement allows the cross member 11 on the bottom of the hand rail 8 when pushed in towards the housing or pulled out from the housing, to depress the flange as it passes over the flange. The cross member when pushed into a locked position is held firmly in place by the force of the flange pressing against it.

In an alternate embodiment wherein the device is as described above with a modified base platform, housing unit and locking mechanism refer to FIGS. 3,4,6,7: The base platform consists of two sections 25,27 held together by some fastening means. The section 25 has a locking device 26 centrally located on its horizontal surface for holding the hand rail in the horizontal position. The section 27 has a locking device 28 centrally located in the vertical plane to hold the hand rail in the vertical position. Each locking device consists of a thin flange 26,28 projecting up on a small angle from the surface upon which it is mounted, and in the direction away from the openings 17 in the housing unit. At a distance along its length the locking device is bent downwards at a sharper angle towards the surface on which it is mounted. This arrangement allows the cross member 11 on the bottom of the hand rail 8 when pushed in towards the housing, or pulled out from the housing, to depress the flange as it passes over the flange. The cross member when pushed in place is held firmly by the force of the flange pressing against it. On the vertical surface of section 25 and between the two base sections is a rectangular recess 29 into which the legs and cross member and rolling means fit when in the vertical position. On the opposing vertical face of section 27 and mounted centrally is positioned the vertical locking device 28. At the intersection of the horizontal and vertical faces of section 27, located centrally and extending downward, outward, and inward is a notch 30. The housing 4 is removable in this embodiment having a horizontal top surface, front, rear, and side surfaces only. The front surface 31 fits into the notch 30 when the housing 4, section 25, and section 27 are all assembled.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A step up platform comprising:

a base platform with a raised horizontal upper surface upon which a person may stand;

means to support and hold the base platform in place on a supporting surface;

a generally hand rail member including a pair of parallel posts and a transverse hand rail interconnecting the posts at an upper end of the posts;

means mounting the posts on the base platform at a position thereon which is offset from a line through a center of the base platform parallel to the posts towards one side edge and which is offset from the side edge leaving a portion of the base platform between the posts and the edge;

said hand rail member including a portion of each of the posts extending through the horizontal raised upper surface into an interior of the base platform;

the base platform including means engaging the hand rail member at the portion of the posts for supporting the posts in vertical position;

the hand rail member being movable from the generally vertical position of the posts to a generally horizontal position of the posts for transport or storage with the portion of the posts being received in the portion of the base platform.

2. The step up platform in accordance with claim 1 wherein the base platform includes means for locking the handrail member in the horizontal position.

3. The step up platform in accordance with claim 1 wherein the hand rail member includes at least a second transverse hand rail parallel to the first transverse hand rail and spaced therefrom a distance down from the top of the posts and lying in a plane parallel to a plane of the posts and spaced from the plane of the posts towards a vertical plane through the center line of the base platform.

4. The step up platform in accordance with claim 1 including roller means on the base platform at said one side edge and at the horizontal upper surface such that the roller means are engaged with the supporting surface when the base platform unit is placed on edge for transport.

5. The step up platform in accordance with claim 4 wherein the roller means are mounted on the hand rail member at said portion of the posts such that the roller means are moved to a position for engagement with the supporting surface only when the hand rail member is folded down in the horizontal position.

6. The step up platform in accordance with claim 1 wherein the hand rail member includes a cross rail interconnecting the posts and wherein the base platform includes 8 housing unit at said portion thereof containing a locking mechanism for engaging the cross rail that enables the hand rail member to be placed in the vertical or horizontal position and lock in place.

7. The step up platform in accordance with claim 6 wherein the locking mechanism comprises a thin rectangular sheet bent at an angle so as to have two faces which are oriented into a generally vertical and generally horizontal position respectively, means defining a channel in the sheet which is deepest at a line of intersection of the two faces and which becomes shallow as distance from the intersection increases, each face having a cross rail engagement member having a first flange bent at an angle from the face in a direction away from the posts and a second flange bent towards the face at an angle sharper than the first flange such that the cross rail can slide over the first flange and the second flange holds the hand rail member in place.

* * * * *